United States Patent [19]

Marcusse et al.

[11] Patent Number: 4,712,337

[45] Date of Patent: Dec. 15, 1987

[54] LOAD-CARRYING STRUCTURE FOR MAKING VOLUME-ENCLOSING CONSTRUCTIONS, IN PARTICULAR FOR PLACING AGAINST BUILDINGS

[75] Inventors: Alain Marcusse; Max Pinel, both of Toulouse, France

[73] Assignee: Technal International S.A., France

[21] Appl. No.: 892,353

[22] Filed: Jul. 31, 1986

[30] Foreign Application Priority Data

Aug. 8, 1985 [FR] France ..... 85 12163

[51] Int. Cl.[4] ..... E04B 7/02

[52] U.S. Cl. ..... 52/90; 52/272; 52/640; 52/643; 52/648; 403/79

[58] Field of Search ..... 403/24, 79, 157; 52/73–75, 90, 92, 272, 273, 281, 283, 284, 637, 638, 640, 643, 648, 721, 726; 47/17

[56] References Cited

U.S. PATENT DOCUMENTS

| | | | |
|---|---|---|---|
| 1,076,290 | 10/1913 | King | 52/14 |
| 1,258,408 | 3/1918 | Hill | 52/90 |
| 1,787,167 | 12/1930 | Purdy | 403/58 |
| 1,921,303 | 8/1933 | Raschka | 52/90 |
| 2,234,960 | 3/1941 | Buelow | 403/233 |
| 3,274,739 | 9/1966 | Gregoire | 52/155 |
| 3,332,179 | 7/1967 | Toti | 52/90 |
| 3,457,689 | 7/1969 | Troutner | 52/639 |
| 4,327,532 | 5/1982 | Matthews | 52/92 |
| 4,601,139 | 7/1986 | Esposito | 52/90 |
| 4,661,007 | 4/1987 | Schneider | 403/24 |

FOREIGN PATENT DOCUMENTS

| | | | |
|---|---|---|---|
| 470653 | 2/1973 | Australia | 52/643 |
| 836805 | 3/1970 | Canada | 52/90 |
| 2389317 | 1/1979 | France | 52/92 |
| 2078274A | 1/1982 | United Kingdom . | |
| 2093144A | 8/1982 | United Kingdom . | |

*Primary Examiner*—John E. Murtagh
*Assistant Examiner*—Andrew Joseph Rudy
*Attorney, Agent, or Firm*—McCormick, Paulding & Huber

[57] ABSTRACT

The invention relates to a load-carrying structure for making volume-enclosing constructions for placing against buildings, and in particular for volume-enclosing constructions having an outside surface with at least two intersecting planes, with at least one of said planes being defined by two parallel load-carrying bars. In accordance with the invention, the line of intersection bars (5, 6) together with link means (11, 12, 13, 15) which are provided for interconnecting the intersection bars, said link means engaging in bar stubs and providing a pivot hinge. The invention is particularly applicable to providing glazed extensions to buildings.

13 Claims, 16 Drawing Figures

FIG. 5
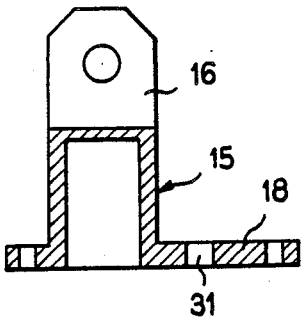
FIG. 2
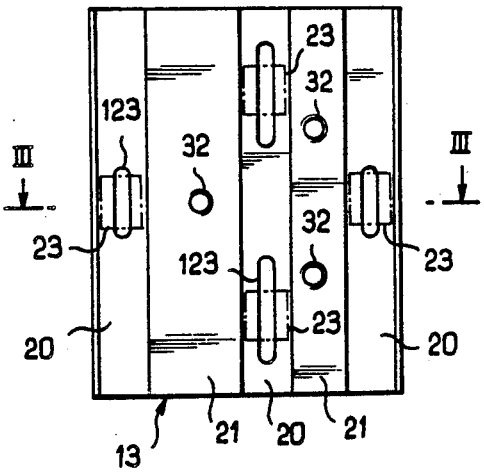
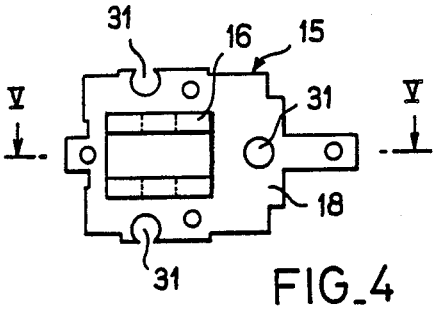
FIG. 4
FIG. 3
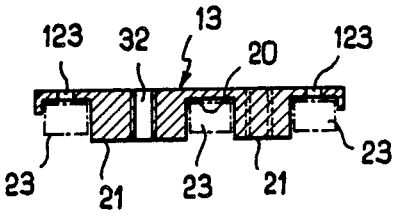
FIG. 7
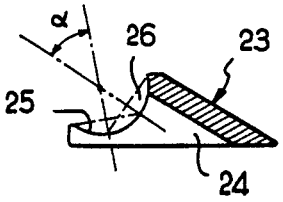
FIG. 8
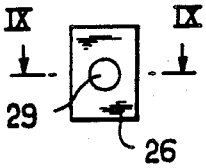
FIG. 6
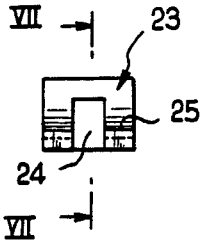
FIG. 9
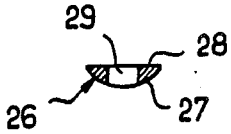

LOAD-CARRYING STRUCTURE FOR MAKING VOLUME-ENCLOSING CONSTRUCTIONS, IN PARTICULAR FOR PLACING AGAINST BUILDINGS

The present invention relates to load-carrying structures for making volume-enclosing constructions, such as conservatories or other glasshouse-type structures for placing against buildings, in particular for improving comfort and/or for constituting passive solar energy collectors.

BACKGROUND OF THE INVENTION

Numerous structures already exist for making volume-enclosing constructions such as conservatories by building up a frame of bars. Examples are described in published British patent applications nos. 2 078 274 and 2 093 144. When said structures need to be load-carrying structures, it is common practice to use steel components which are assembled on site by welding. Once the frame has been assembled, bars of light alloy, and in particular of aluminum, are used for making the facings of the volume-enclosing construction, and these bars are subjected only to minimal forces which are extremely small compared to those which the steel frame is required to withstand.

It is tempting to use light alloy bars for making a load-carrying structure when providing a volume-enclosing construction including at least a first plane which is defined by load-carrying bars running parallel to one another, and further including at least one other plane which intersects the first, i.e. which constitutes the geometrical figure of a dihedral. In order to make this possible, it is necessary to solve the problem of transmitting forces between the two planes under consideration of the load-carrying structure.

When the line of intersection between the intersecting planes runs orthogonally to the directions in which the load-carrying bars extend, the problem may be solved by providing a simple direct link between the adjacent ends of the load-carrying bars. Such a solution is illustrated, for example, in U.S. Pat. No. 4,327,532.

However, when the line of intersection between the planes may be at an arbitrary angle relative to the direction of the load-carrying bars defining one, or in particular both, of the intersecting planes, it becomes difficult to design a simple inter-plane link by virtue of the complication inherent to assembling such planes if the resulting assembly is to be rigid enough. Thus, for example, when using a variable angle assembly of the type described in the above-specified U.S. patent, direct fixing to the webs of the bars is not suitable, in particular when forces are to be transmitted. This becomes even more difficult to provide when the line of intersection is no longer orthogonal to the direction along which the load-carrying bars extend. That is why steel bars which are assembled mechanically and by welding are preferred for complicated frames in spite of the difficulties of using special equipment on site, such as welding equipment, and in spite of the resulting frame having poor resistance to corrosion. Furthermore, the need to ensure that such a volume is acceptable in appearance leads to the use of additional facing components, thereby further increasing manufacturing time and also making it difficult to perform periodic inspections of the vulnerable areas of the frame in which weaknesses may be started by fatigue and/or corrosion phenomena.

Preferred embodiments of the present invention provide a load-carrying structure capable of being made from bars of light alloy (and in particular from aluminum bars), using conventional mechanical assembly techniques, and in particular avoiding the need for welding.

An aim of the invention is to provide a load-carrying structure which is particularly suitable for making any shape of roof framework, and is also capable of being placed against facade frameworks or against the main structure of a building, said load-carrying bars being capable of extending over a wide range of directions relative to each other when defining any given pair of intersecting planes.

Another aim of the invention is to provide a load-carrying structure having subassemblies capable of being pre-assembled in a factory, thereby further reducing on-site assembly time.

Another aim of the invention is to make it possible to provide load-carrying frames having a wide variety of prismatic shapes, and in particular to provide all shapes of roof frame, e.g. valleys or gables, etc. In other words, the invention is generally applicable to any type of join between roofing planes, or between facade planes, or between a roofing plane and a facade plane, regardless of whether any of the planes intersecting along a given line are vertical or not.

SUMMARY OF THE INVENTION

The present invention provides a load-carrying structure for making a volume-enclosing construction suitable, in particular, for being applied against a building, the outside surface of said volume-enclosing constructing including at least two intersecting planes constituting the geometrical figure of a dihedral, at least one of said planes being defined by at least two load-carrying bars having longitudinally-extending cavities, and the edge of each plane adjacent to a line of intersection with another plane being constituted by an intersection bar including a central web, the load-carrying structure including the improvement of first link means which are provided for fixing each intersection bar to the associated one of said planes, said first link means comprising, when the plane is defined by load-carrying bars, by bar stubs which are fixed to said intersection bar by means of an intermediate bearing plate and which are inserted endwise into the corresponding cavities of said load-carrying bars, and of second link means which are provided between the intersection bars, said second link means including joining parts which are fixed to the central webs of the intersection bars and which together define a hinge pivoted about an axis which runs substantially parallel to the line of intersection between said planes, but which runs at any desired angle relative to the direction of the load-carrying bars defining the or each intersecting plane, said first and second link means being capable of being disassembled and serving, without the need for welded link, to transport forces between the two planes linked thereby of the load-carrying structure.

In a first type of embodiment, one of the two intersecting planes is defined by load-carrying bars having respective longitudinal cavities, said load-carrying bars extending, preferably, along a direction which is essentially parallel to the line of greatest slope of said plane, the other one of said planes being defined by the building itself, first link means for the intersection bar associated with said latter plane directly fixing said intersection to the main structure.

In another type of embodiment, each of the two intersecting planes is defined by load-carrying bars having respective longitudinally-extending cavities, said load-carrying bars running, preferably, along a direction which is essentially parallel to the line of greatest slope of the plane which they define.

In order to obtain a particularly rigid assembly, it is advantageous for at least some of the load-carrying bars are essentially organized in pairs of identical bars, a pair comprising a load-carrying bar in each plane, the first and second link means being disposed at the ends of said load-carrying bars.

In a preferred embodiment, each intersection bar includes a generally plane central web, with the first and second link means being disposed on either side thereof, said web having oblong holes passing therethrough to enable the intermediate bearing parts to be adjusted in position on the associated stubs of bar, on site. The end sections of the load-carrying bars and of the associated bar stubs adjacent to the intersection bar under consideration form planes which are essentially parallel to the direction along which said intersection bar extends.

For structures in which the intersection bars are at arbitrary angles to the load-carrying bars, it is advantageous for the intermediate bearing plates to be fixed both to an end section of bar stub and also against the adjacent face of the central web of the corresponding intersection bar. In this case each intermediate bearing plate includes at least one groove in its side opposite to the end section of bar stub, the or each of said grooves receiving fixing means for fixing said plate to said bar stub, said means enabling the plane of said end section to be fixed over a range of angles relative to a right cross-section, thereby enabling the same components to be adapted to a wide range of situations and also to take up any slack which may occur during assembly. In particular, the means for fixing an intermediate bearing plate to a stub of bar include at least one bearing shoe disposed in an associated groove of said plate, said shoe supporting a wedge capable of occupying variable orientations and serving as a bearing surface for the head of a fixing bolt, and the wedge has a plane face for bearing against the head of the bolt and a curved face disposed against a corresponding cradle provided on the bearing shoe.

For a general type of embodiment said second link means include at least one joining part bearing against the central web of an intermediate bar and fixed to the intermediate bearing plate by means which pass through the central web of the intersection bar.

Preferably, a cover plate is snap-fitted to the, or each, intersection bar in order to reconstitute the rabbet of said bar and to define a filling volume in conjunction therewith, said cover plate having openings for passing the ends of the load-carrying bars while masking the assembly of said load-carrying bars with the associated intersection bar.

For making volume-enclosing constructions of complex shapes, bar stubs of reduced cross-section are provided for engaging in load-carrying half-bars associated with the connection zone between two adjacent lines of intersection between two pairs of intersecting planes, which pairs of planes also intersect each other.

BRIEF DESCRIPTION OF THE DRAWINGS

Embodiments of the invention are described with reference to the accompanying drawings, in which:

FIG. 2 is a plan view of an intermediate bearing plate for fixing to an insertable bar stub and thus, in accordance with the invention, for providing a link between a load-carrying bar and an adjacent intersection bar;

FIG. 3 is a section along III—III of FIG. 2;

FIG. 4 is a plan view of a joining part for use, in accordance with the invention, not only for providing a link between two intersection bars when a matching pair of such joining parts is used, but also for rigidly assembling to bar stubs through a corresponding intersection bar;

FIG. 5 is a section on a line V—V of FIG. 4;

FIG. 6 and the associated FIG. 7 section on line VII—VII show a bearing shoe suitable for use in the link between the intermediate plate of FIGS. 2 and 3 and an insertable bar stub;

FIG. 8 and the associated FIG. 9 section on line IX—IX show a wedge having a curved face suitable for bearing against the shoe of FIGS. 6 and 7 at various different angles;

MORE DETAILED DESCRIPTION

The load-carrying structures shown in FIGS. 1*a* to 1*e* are merely specific examples of volume-enclosing constructions for placing against buildings, and it will readily be understood that other configurations of load-carrying structures are possible within the scope of the invention.

In general terms, the invention relates to load-carrying structures having an outside surface with at least two planes at an angle to each other, i.e. constituting the geometrical figure known as a dihedral, with at least one of said planes being defined by at least two parallel load-carrying bars, each of which has a longitudinally-extending cavity.

FIGS. 1*a* to 1*e* show the load-carrying structures diagrammatically and serve to facilitate understanding the organization of the connections between the components constituting the structures, which connections are described in greater detail below. The complexity of the assembly varies depending on the relative disposition of the parallel load-carrying bars and the intersection between the planes.

Figure 1A:
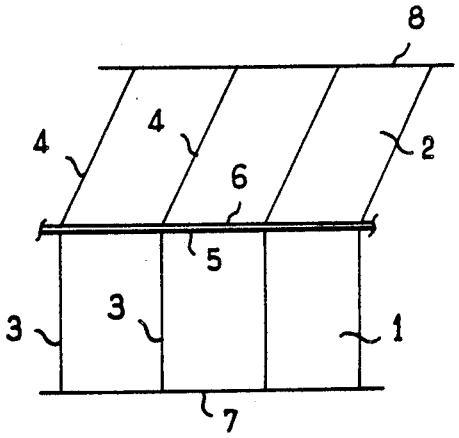
FIGS. 1*a* to 1*e* are diagrams showing different types of load-carrying structure which can be provided in accordance with the present invention.

In FIG. 1*a*, the load-carrying structure has an intersection between a vertical facade plane 1 a sloping roof plane 2. The facade plane 1 is "defined" by load-carrying bars 3 and the roof plane is "defined" by load-carrying bars 4 (where the term "defined" is used to simplify the description of the invention, but it should naturally be understood that in the finished volume-enclosing construction various types of panel or filler component extend between adjacent load-carrying bars and physically occupy the plane under consideration). The edges of planes 1 and 2 running along the intersection therebetween is physically constituted by intersection bars 5 and 6. Lines 7 and 8 symbolize the connections between the other ends of the load-carrying bars and a main building. Since such connections are already well-known in the art, they are not described herein in order to avoid excessively lengthening the description. It should be observed here that the intersection bars 5 and 6 extend along a direction which is essentially orthogonal to the direction of the load-carrying bars in each plane, and that the intersection bars are organized by pairs of identical bars, with each pair comprising one load-carrying bar in each of the intersecting planes. It may be observed that the FIG. 1*a* structure corresponds to a frequently used design (see, for example, U.S. Pat. No. 4,327,532). This structure is nevertheless illustrated here in order to underline the fact that a load-carrying structure in accordance with the invention is perfectly capable of being used for the conventional case where the line of intersection is orthogonal to the direction of the load-carrying bars, even though it is specifically intended to make complex assemblies possible such as those illustrated below (and in particular where the line of intersection is at a different direction relative to the planes in which it is contained).

Figure 1B:
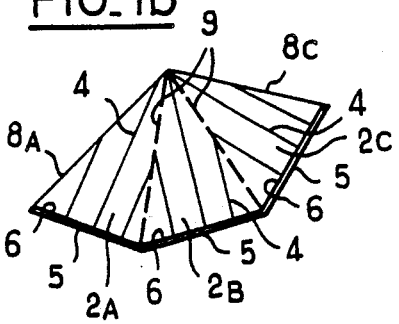

FIG. 1*b* shows a load-carrying structure in which the roof portion is built up from three planes $2_A$, $2_B$, and $2_C$ each of which is defined by parallel load-carrying bars 4, with the connection to the plane of the building being symbolized by lines $8_A$ and $8_C$. Since the planes $2_A$, $2_B$, and $2_C$ are not coplanar, they define ridges at their lines of intersection. The structure shown in FIG. 1*b* is for placing on top of a plane structure, in other words the bottom intersection bars 5 are directly fixed to the main structure. It is important to observe that in this particular structure, each of the intersection bars 5 constitutes a simple edge of a vertical plane reduced to the simplest possible case, i.e. a plane which is not defined by load-carrying bars. In addition, as for the previous structure, the intersection bars 5 and 6 extend along directions which are essentially orthogonal to the directions of the load-carrying bars in each plane. This principle can be used to provide an independent volume-enclosing construction, i.e. a construction which is fixed to a main structure, but which is not necessarily placed against a building or the like.

Figure 1C:
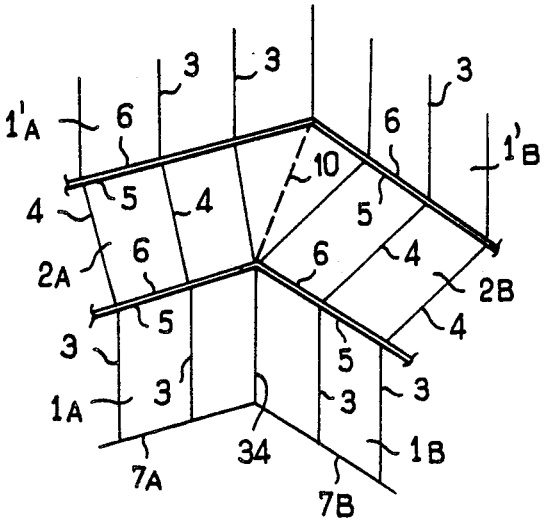

In FIG. 1*c*, the load-carrying structure comprises a bottom facade which, in this case, is vertical, and which comprises two planes $1_A$ and $1_B$ (with bottom edges $7_A$ and $7_B$), a roof constituted two planes $2_A$ and $2_B$ defining a valley 10 (i.e. a re-entrant angle), and a top facade constituted by two planes $1'_A$ and $1'_B$. This is a more elaborate version of the structure shown in FIG. 1*a* and it provides a problem that needs to be solved concerning the middle connections (and in particular in a vertical plane passing through the valley 10). In this plane there is a triple node, i.e. a vertical load-carrying bar 3 needs to be connected to two load-carrying bars 4. This problem is solved by the present invention in manner which is described below with reference to FIG. 12. As above, the directions of the load-carrying bars and of the intersection bars are orthogonal at each intersection between two planes.

Figure 1D:
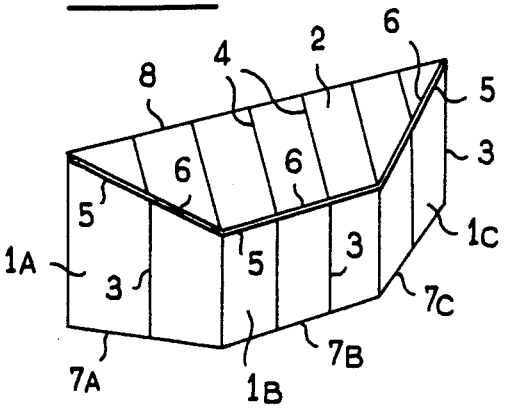

In FIG. 1*d*, the load-carrying structure comprises a facade built up from three planes $1_A$, $1_B$, and $1_C$ (having bottom edge $7_A$, $7_B$, and $7_C$), while the roof is constituted by a single plane 2. The load-carrying bars 3 and 4 are organized, as before, in pairs, but in contrast some of these pairs (in particular the side-sloping ridges) are constituted by load-carrying bars which extend in a direction which is not orthogonal to the intersection bars 5, 6. The invention is particularly useful for connections of this type, since it will readily be understood that on site assembly is impossible for poorly qualified personnel given the difficulty of properly positioning the components relative to one another, if progressive welding is to be avoided.

Figure 1E:
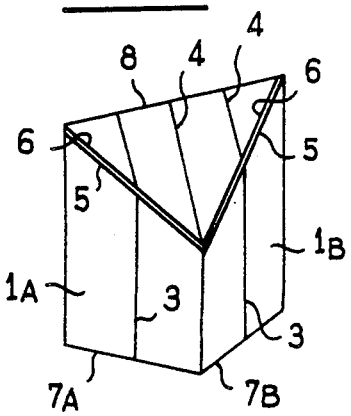

In FIG. 1*e*, the load-carrying structure is similar to that shown in FIG. 1*d* except that the facade has only two planes $1_A$ and $1_B$ and the roof has a single plane 2. In this case there are two angled ridges in which the load-carrying bars and the adjacent intersection bars are not orthogonal.

In accordance with an essential aspect of the present invention, the load-carrying structure comprises first link means between the load-carrying bars in the same plane of a given intersection and the adjacent intersection bar, using bar stubs which are fixed to said intersection bar by means of an intermediate bearing plate and which are inserted endwise into the corresponding cavities of said load-carrying bars, and second link means between the two intersection bars of the intersection, said second link means comprising joining parts fixed to the central webs of the intersection bars and defining a hinge which pivots about an axis parallel to the intersection of the planes under consideration; said link means are capable of being disassembled and thus are capable of transmitting forces between the two intersecting planes without using a welded link.

Figure 10:
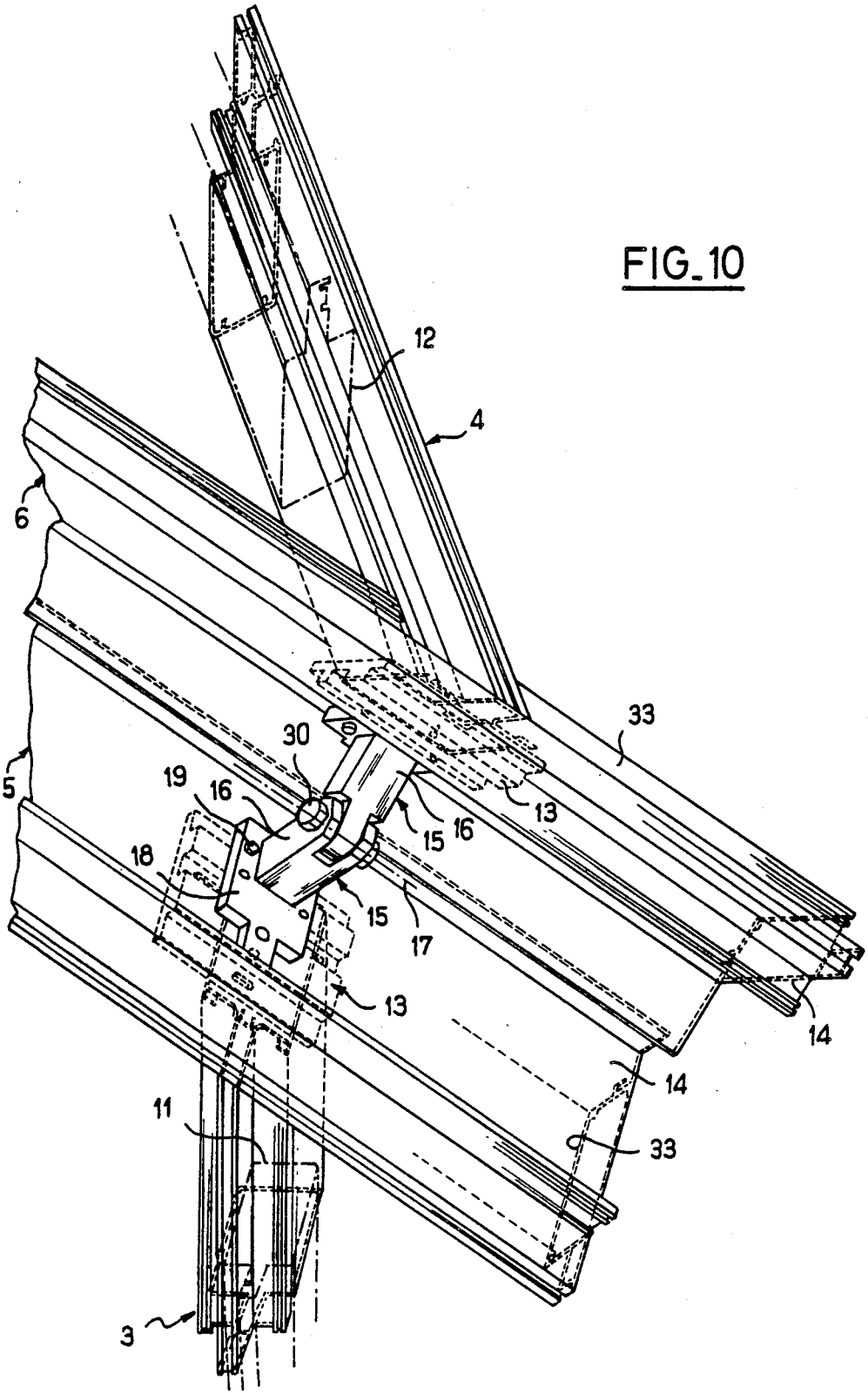
FIG. 10 is a perspective view of a connection node in accordance with the invention between roof frame members and facade frame members, the portions of the hinged parts which are not shown in the drawing being omitted to avoid cluttering the figure, and such a node corresponding to a structure where the direction between the load-carrying bars and the associated intersection bars can be at any angle according to choice, and in particular, said node is applicable to the structures of the types shown in FIGS. 1*d* and 1*e;*
Figure 11:
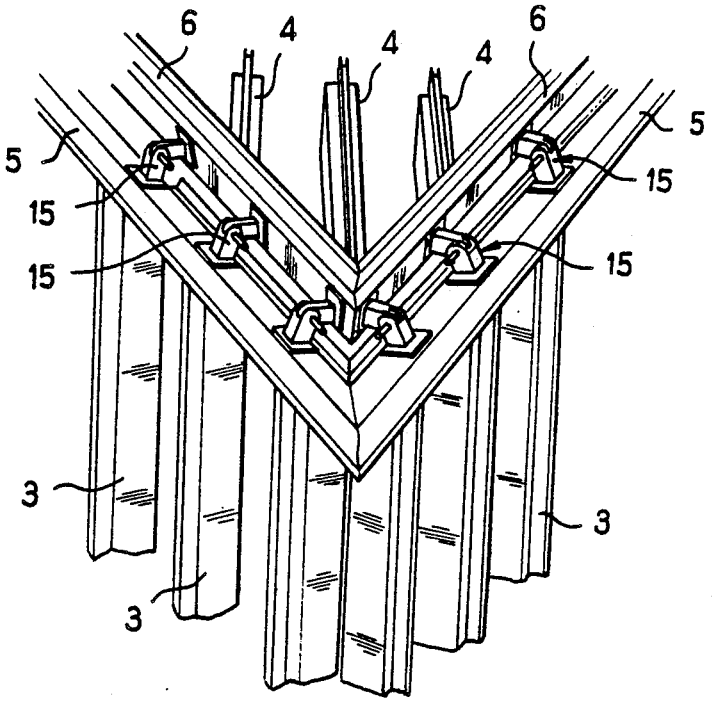
FIG. 11 is a perspective view showing a larger portion of a structure than FIG. 10, and in particular it shows a portion of a load-carrying structure in accordance with the invention where the insertable bar stubs are not visible, said structure being of the type shown in FIG. 1*b.

One example of such link means is illustrated in FIGS. 2 to 9, and an assembled node on a ridge is shown in FIG. 10, with a portion of a more complex structure, i.e. of the type shown in FIG. 1*e*, being shown in FIG. 11.

It should be observed that the bars 3 to 6 shown in FIG. 10 are of conventional types, and that the particular shapes of their cross-sections does not form a part of the invention (grooves are provided, in the usual way, in order to receive sealing gaskets and/or various panel-fixing members). Naturally, the load-carrying bars which are of closed box section in the present example could be of open section e.g. U-shaped or omega-shaped, so long as a longitudinally-extending cavity is defined by the bar.

It may be observed that the load-carrying bars 3 and 4 are identical to each other as are the intersection bars 5 and 6, however this is not essential but merely constitutes an advantage during assembly and for reducing the cost of producing the structure. The link means are thus preferably identical on either side of the intersection between planes.

In accordance with a particularly important aspect of the invention, sleeve-constituting bar stubs 11 and 12 are fixed to respective intermediate bearing plates 13 which are themselves fixed against the adjacent face of the central webs 14 of the intersection bars. The outside shapes of the bar stubs or sleeves 11 and 12 are suitable for being received in the longitudinal cavities of the load-carrying bars. In order to avoid overloading the figures, these bar stubs are shown symbolically by dot-dashed lines representative of their right cross-sections at their free ends.

These stubs should not be too long in order to avoid complicating assembly, however they must be long enough to receive bending forces. The other ends of these stubs adjacent to the intersection bars have section angles identical to the sections of the load-carrying bars, which angles define the direction of the intersection between planes.

If necessary, an additional link may be provided between the bar stubs and the associated load-carrying bars, for example by means of bolts.

On the other side of the web 14 there is a joining part 15 having a post 16 which constitutes a component of a hinge about a pivot axis 17, said joining part has a base 18 fixed against the intersection bar (in this case by bolts 19 passing through the web of said intersection bar and received in associated tapped holes in the intermediate bearing plate 13). The web 14 is advantageously drilled with oblong holes (not shown) to enable the position of the intermediate bearing plate 13 to be adjusted on the associated stub of bar 11 or 12. The web 14 may also include a longitudinally extending middle groove (not shown) enabling further adjustment of the position of the post 16, thereby further facilitating on site adjustments and avoiding any need for prior assembly and/or machining.

The structure of the link means will be better understood from reference to FIGS. 2 to 9.

The intermediate bearing plate 13 (FIGS. 2 and 3) has grooves 20 delimiting two bearing faces 21 which come into contact with the web of the intersection bar once assembly has been completed, and which are suitable for receiving bearing shoes 23 whose positions are adjustable by virtue of oblong holes such as 123. These shoes (FIGS. 6 and 7) have a central hollow 24 and a curved cradle 25 which receive thrust from a wedge 26 (see FIGS. 8 and 9). This wedge has a curved face 27 to allow for a degree of angular freedom (through an angle $\alpha$) relative to the shoe 23, and a plane face 28 providing an effective and well-adjusted bearing surface for a fixing bolt. The plate 13 is easily fixed to the associated stub of sleeve-forming bar by means of bolts whose rods pass through associated openings 29 through the wedges, the hollows 24 in the shoes, the oblong holes 123 in the plate, and finally through screw-receiving holes provided for the purpose on said stubs.

The joining part 15 has a base 18 with a post 16 projecting therefrom and intended to receive a hinge bolt 30 (see FIG. 10). Holes 31 allow the rods of fixing bolts to be passed through the base 18 and to be received in associated tapped holes 32 in the intermediate bearing plate 13 after passing through the web of the intersection bar.

It may be observed that if the intersection line is not at an angle as illustrated in FIG. 10, but is merely associated with a simpler node dealing with orthogonal directions between the load-carrying bars and the adjacent intersection bars, then the intermediate bearing plate 13 may be omitted. To this end, the base 18 of the joining part is advantageously provided with a contour which corresponds substantially to the right cross-section of the bar stub for being directly fixed thereto, thus avoiding the need to provide two different types of joining part.

Covers 33 (see FIG. 10) are advantageously snap-fitted to the intersection bars in order to reconstitute its rabbet and to define a filling volume in association therewith, while also improving the appearance of the structure (openings are provided to pass the ends of the load-carrying bars while simultaneously masking the assembly). Naturally a cover (not shown) will be used for masking the link means disposed between two adjacent intersection bars.

Figure 12:
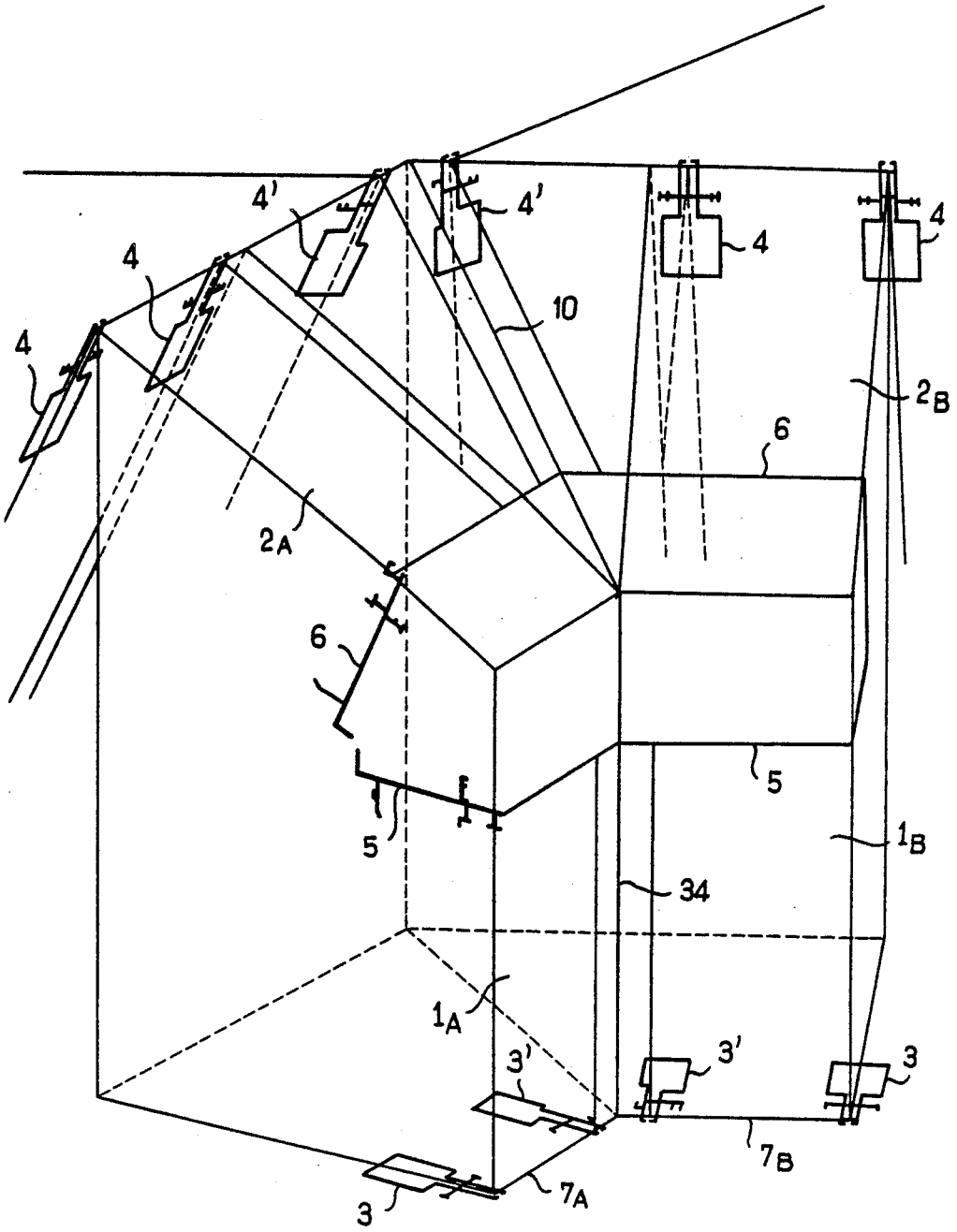
* and FIG. 12 is a diagrammatic view showing one possible embodiment of a connection between adjacent intersections whose respective pairs of intersecting planes themselves intersect, this configuration being of the type shown in FIG. 1*c* and load-carrying half-bars are used for receiving bar stubs of smaller cross-sectional area, with the principle of assembly links in accordance with the invention remaining essentially unchanged.

Special cases such as a triple node in the vicinity of a valley are solved as illustrated in FIG. 12. A roof valley 10 and a facade junction line 34 are defined by half-bars 4' and 3'. Connections with the intersection bars are provided on the same lines, but smaller section bar stubs are used in order to enable them to be inserted into the half-bars. Other special cases can be resolved in like manner. Drainage and finishing can thus be provided in the same manner as for the roof connections on a single facade.

Naturally, the principle of using stubs of inter-fitting bars may be used for fixing load-carrying posts of the main building (e.g. lines 7 and 8) by means of an intermediate plate analogous to the plate 13 and capable of accepting a load-carrying bar 3 or 4 at an angle relative to the bearing plane on the main building. The only case where this type of connection cannot be used is when the bottom intersection bar is directly fixed to the main building (see FIG. 1*b*). However, it is advantageous to use it as often as possible since it constitutes a simple system which avoids the need for accurate adjustment of the assembly equipment, and provides good mechanical strength (relative to bending forces, and to absorbing displacements due to expansion and contraction).

A load-carrying structure in accordance with the invention is easily pre-assembled in a factory into subunits, thereby facilitating final assembly on site, thereby avoiding many opportunities for clumsy or wrong assembly.

The invention is not limited to the embodiments described above, but is applicable to any variant which uses equivalent means to satisfy the essential features as specified in the accompanying claims.

We claim:

1. A load-carrying structure for making a volume-enclosing construction suitable, in particular, for being applied against a building, said volume-enclosing construction having an outside surface including two planes which intersect along a line of intersection and constitute the geometrical figure of a dihedral, at least one of said planes being defined by at least two load-carrying bars having longitudinal axes and longitudinally-extending cavities, two intersection bars each having a central web, and each of said planes having an edge along said line of intersection which edge is constituted by an associated one of said intersection bars, said load-carrying structure including the improvement of first link means for fixing each of said intersection bars to the associated one of said planes, said first link means including, at least when said associated one of said planes is defined by load-carrying bars, bar stubs which are fixed to said intersection bar by means of an intermediate bearing plate and which are inserted end wise into corresponding ones of said cavities of said load-carrying bars, and of second link means which are provided between said intersection bars, said second link means including two joining parts each fixed to said central web of a respective one of said two intersection bars, means releasably connecting said two joining parts to one another as a hinge for pivotal movement relative to one another about an axis which runs substantially parallel to said line of intersection between said two planes, but which runs at any desired angle relative to said longitudinal axes of said load-carrying bars defining said intersecting planes, and means releasably fixing said intermediate bearing plates and said two joining parts to the associated ones of said central webs of said two intersection bars so that said first and second link means are capable of being disassembled from said intersection bars and from said load-carrying bars.

2. A load-carrying structure according to claim 1 wherein one of said two intersecting planes is defined by load-carrying bars and has a line of maximum slope, said load-carrying bars having respective longitudinal cavities and extending along a direction essentially parallel to said line of greatest slope of said one plane, the other of said two planes being defined by said building itself, the one of said first link means which is fixed to the one of said intersection bars associated with said other plane being directly fixed to said building.

3. A load-carrying structure according to claim 1 wherein each of said two intersecting planes has a line of greatest slope and is defined by load-carrying bars having respective longitudinally cavities, said load-carrying bars running along a direction which is essentially parallel to said line of greatest slope of the one of said two planes which they define.

4. A load-carrying structure according to claim 3 wherein at least some of said load-carrying bars are essentially organized in pairs of bars, a pair comprising a load-carrying bar in each of said two planes and each of which load-carrying bars has a first end adjacent said intersection line, said first and second link means being disposed at said first ends of said load-carrying bars.

5. A load-carrying structure according to claim 1 wherein each intersection bar includes a generally plane central web, with the ones of said first and second link means which are fixed to each of said intersection bars being disposed on either side of said central web of said intersection bar, said web having oblong holes passing therethrough enabling said first and second link means to be adjusted in position relative to said intersection bar on site.

6. A load-carrying structure according to claim 5 wherein each of said intermediate bearing plates is fixed to one of said bar stubs and also to the central web of the associated one of said intersection bars.

7. A load-carrying structure according to claim 1 wherein said load-carrying bars are essentially perpendicular to said intersection line.

8. A load-carrying structure according to claim 6 wherein each of said intermediate bearing plates has a side facing said central web of said intersection bar to which it is fixed, said side of said intermediate plate including a groove receiving fixing means for fixing said plate to an associated one of said bar stubs, said associated one of said bar stubs having an end faceing engaging said intermediate bearing plate, said fixing means enabling said bearing plate to be fixed to said bar stub regardless of the angle said end face may take over a wide range of angles relative to the longitudinal axes of said bar stubs.

9. A load-carrying structure according to claim 8 wherein said means for fixing said intermediate bearing plate to a bar stub includes at least one bearing shoe disposed in said groove of said plate, a fixing bolt threaded into said bar stub and having a head, and said shoe supporting a wedge capable of occupying variable orientations and serving as a bearing surface for said head of said fixing bolt.

10. A load-carrying structure according to claim 9 wherein said wedge has a plane face for bearing against said head of said bolt and a curved face disposed against a corresponding cradle provided on said bearing shoe.

11. A load-carrying structure according to claim 1 wherein each of said joining parts of said second link means bears against said central web of the associated one of said intersection bars and is fixed to an associated one of said intermediate bearing plates by means which pass through said central web of said associated intersection bar.

12. A load-carrying structure according to claim 1 wherein a cover plate is snap-fitted to at least one of said two intersection bars in order to provide a rabbet and to define a filling volume, said cover plate having openings through which said load-carrying bars pass and masking the assembly of said load-carrying bars with said intersection bars.

13. A load-carrying structure according to claim 1 wherein bar stubs of reduced cross-section are provided for engaging in load-carrying half-bars associated with a connection zone including two intersecting lines of intersection between two pairs of intersecting planes, which pairs of planes also intersect each other.

* * * * *